US012460381B2

(12) United States Patent
Komori

(10) Patent No.: US 12,460,381 B2
(45) Date of Patent: Nov. 4, 2025

(54) DRIVE TRANSMISSION DEVICE AND CONSTRUCTION MACHINE

(71) Applicant: Nabtesco Corporation, Tokyo (JP)

(72) Inventor: Etsuro Komori, Tokyo (JP)

(73) Assignee: NABTESCO CORPORATION, Tokyo (JP)

( * ) Notice: Subject to any disclaimer, the term of this patent is extended or adjusted under 35 U.S.C. 154(b) by 880 days.

(21) Appl. No.: 17/690,103

(22) Filed: Mar. 9, 2022

(65) Prior Publication Data

US 2022/0316185 A1 Oct. 6, 2022

(30) Foreign Application Priority Data

Mar. 31, 2021 (JP) ..... 2021-062022
Nov. 10, 2021 (JP) ..... 2021-183704

(51) Int. Cl.
*E02F 3/36* (2006.01)
*E02F 9/20* (2006.01)

(52) U.S. Cl.
CPC ..... *E02F 9/2095* (2013.01); *E02F 9/207* (2013.01); *E02F 3/3604* (2013.01)

(58) Field of Classification Search
CPC ..... E02F 3/3681; E02F 3/425; E02F 3/3609; E02F 3/3677; E02F 9/006; E02F 3/3604;
(Continued)

(56) References Cited

U.S. PATENT DOCUMENTS 4,884,844 A * 12/1989 Kershaw ..... B60N 2/2252 475/162
4,958,981 A * 9/1990 Uchihashi ..... E02F 3/3677 414/723

(Continued)

FOREIGN PATENT DOCUMENTS

CN 113463701 A * 10/2021
DE 1118696 B 11/1961

(Continued)

OTHER PUBLICATIONS

Extended European Search Report dated Sep. 30, 2022, issued in corresponding European Patent Application No. 22161086.8 (9 pgs.)

*Primary Examiner* — Sherry L Estremsky
(74) *Attorney, Agent, or Firm* — Pillsbury Winthrop Shaw Pittman, LLP

(57) ABSTRACT

A drive transmission device includes a first member and a second member rotatably coupled about a rotation axis; a drive source generating a rotational force that drives the first member and the second member; speed reducers transmitting the rotational force from the drive source to the second member; at least two bracket portions arranged in the rotation axis direction in the second member; and a flange portion extending in a direction intersecting the rotation axis, having an overlapping region where the flange portion overlaps the bracket portion viewed from a direction along the rotation axis direction, and connecting the speed reducer and the bracket portion. A restricting member that extends in the rotation axis direction and restricts the relative rotational movement between the bracket portion and the flange portion, and a receiving portion that receives the restricting member are provided in the overlapping region.

10 Claims, 12 Drawing Sheets

(58) Field of Classification Search
CPC ..... E02F 3/3654; F16H 1/32; B60N 2/225; B60N 2/2251; B60N 2/2252
See application file for complete search history.

(56) References Cited

U.S. PATENT DOCUMENTS

| | | | | |
|---|---|---|---|---|
| 6,168,235 | B1 * | 1/2001 | Freund | B60N 2/2252 297/361.1 |
| 8,539,699 | B2 * | 9/2013 | Ramun | E02F 3/3631 37/403 |
| 10,273,661 | B2 * | 4/2019 | Shahroudi | E02F 9/006 |
| 2024/0106681 | A1 * | 3/2024 | Schaefer | H04L 12/4625 |

FOREIGN PATENT DOCUMENTS

| | | | | |
|---|---|---|---|---|
| DE | 3914084 | A1 | * | 10/1990 |
| EP | 3382103 | A2 | * | 10/2018 |
| FR | 2459026 | A1 | * | 1/1981 |
| JP | 63-300131 | A | | 12/1988 |
| JP | H07279193 | A | * | 10/1995 |
| JP | 8-151654 | A | | 6/1996 |
| JP | H08151654 | A | * | 6/1996 |
| KR | 101442185 | B1 | * | 9/2014 |
| WO | 03/018917 | A1 | | 3/2003 |
| WO | WO-2015051418 | A1 | * | 4/2015 |
| WO | WO-2015193546 | A2 | * | 12/2015 |

* cited by examiner

DRIVE TRANSMISSION DEVICE AND CONSTRUCTION MACHINE

CROSS-REFERENCE TO RELATED APPLICATIONS

This application is based on and claims the benefit of priority from Japanese Patent Application Serial Nos. 2021-062022 (filed on Mar. 31, 2021) and 2021-183704 (filed on Nov. 10, 2021), the contents of which are incorporated herein.

TECHNICAL FIELD

The present disclosure relates to a drive transmission device and a construction machine, and in particular to features suitable for actuators used in coupling portions of excavators.

BACKGROUND

Construction machines such as a hydraulic excavator includes a self-propelled undercarriage, a slewable upper structure provided on top of the undercarriage (for example, see Japanese Patent Application Publication Sho. 63-300131). The slewable upper structure includes a cab where an operator boards. An operating unit is rotatably (swingably) coupled to the slewable upper structure. The operating unit includes, for example, a boom whose one end is rotatably coupled to the upper structure, an arm rotatably coupled to the other end of the boom, and a bucket rotatably coupled to the other end of the arm.

In many cases, a hydraulic actuator having a linear motion mechanism is provided as a drive transmission device in the coupling portion between the slewable upper structure and the boom, the coupling portion between the boom and the arm, and the coupling portion between the arm and the bucket. The slewable upper structure is rotated relative to the undercarriage, and the boom, arm, and bucket are swingably moved by driving the hydraulic actuators. In a conventional coupling portion between the arm and the bucket, a rotating member is rotatably coupled by a pin. In this structure, since the coupling portion has backlash in the rotation axis direction, it is not necessary to adjust a gap at the coupling portion. Buckets or the like may be replaced with different attachments.

In recent years, electrification of construction machinery is desired from the viewpoint of structural simplification. It has been proposed to use electric rotary actuators as the drive transmission devices.

When applying rotary actuators to a coupling portion, the rotary actuators may be arranged in series in the rotation axis direction to address moment generated in the rotation axis direction.

When the rotary actuators are arranged in series in the rotation axis direction in such a coupling portion, a fitting span of the rotary actuator in the rotation axis direction is fixed. Fitting spans of attachments such as buckets in the rotation axis direction are fixed.

SUMMARY

In the structure where the rotary electric actuators are arranged in series in the rotation axis direction in the coupling portion, it is necessary to provide a clearance for allowing the actuators with the fixed fitting spans to be arranged. The gap needs to be adjusted by a shim(s), a spacer(s), etc. When replacing different attachments such as buckets, it is necessary to adjust the gap for the fitting span of the rotary electric actuator for each attachment. There is a demand to simplify the adjustment work or to reduce the number of work steps for such a gap caused by different fitting spans.

The present disclosure provides a drive transmission device that serves as a coupling portion with which a gap adjustment work is simplified even when using an electric actuator therein, and a construction machine equipped with such a drive transmission device.

(1) A drive transmission device according to one aspect of the disclosure includes: at least one speed reducer attached to a first member, the speed reducer transmitting a rotational force from a drive source to a second member that is rotatable about a rotation axis and coupled to the first member; at least two bracket portions provided in the second member, the at least two bracket portions being arranged apart from each other in a direction of the rotation axis; at least two bracket portions provided in the second member, the at least two bracket portions being arranged apart from each other in a direction of the rotation axis; a restricting member disposed so as to extend in the direction of the rotation axis, the restricting member restricting a relative rotational movement of the bracket portions and the flange portion; and a receiving portion receiving the restricting member. When a region where the bracket portion and the flange portion overlap each other viewed from the direction of the rotation axis is defined as an overlapping region, the restricting member and the receiving portion are disposed in the overlapping region.

With this configuration, the second member can be rotationally driven relative to the first member via the speed reducer, the flange portion, and the bracket portion by the rotational driving force of the drive source. The restricting member and the receiving portion restrict positional movement and posture around the rotation axis while the restricting member and the receiving portion allow a dimensional error in the rotation axis direction between the flange portion and the bracket portion. At the same time, the restricting member and the receiving portion allow relative movement between the bracket portion and the flange portion in the direction along the rotation axis based on the separation distance between the bracket portions in the direction along the rotation axis. Thus, when the second member and the first member are assembled and connected to each other, there is no need to care about dimensional errors in the direction of the rotation axis. There is no need to care about the assembling attitudes of the second member and the first member. Therefore, it is possible to easily assemble the second member and the first member, thereby improving workability. Further, when replacing the second member with respect to the first member, there is no need to care about dimensional errors in the direction of the rotation axis. There is no need to care about the assembling attitudes of the second member and the first member. Therefore, it is possible to easily assemble the second member and the first member, thereby improving workability.

(2) In one embodiment, in the drive transmission device (1) described above, two or more sets of the receiving portion and the restricting member are provided around the rotation axis. The receiving portions have a round sectional shape viewed in a direction intersecting the rotation axis. Here, the two or more sets provided around the rotation axis include both cases where they are arranged in the radial direction with respect to the rotation axis and cases where they are arranged in the circumferential direction with respect to the rotation axis. Moreover the sectional shape viewed in the direction intersecting the rotation axis direction may include inclined cross sections in addition to the cross sections orthogonal to the rotation axis direction.

(3) In one embodiment, in the drive transmission device (1) described above, one set of the receiving portion and the restricting member is provided around the rotation axis, and the receiving portion may have a polygonal sectional shape viewed in a direction intersecting the rotation axis. The polygonal cross-sectional shape of the receiving portion may be formed in any shape provided that the restricting member can be prevented from rotating around the axis relative to the connected receiving portion. For example, the shape may include polygonal shapes a part of which is formed by a curve or polygonal shapes formed only by curves. The sectional shape of the receiving portion and the sectional shape of the restricting portion may or may not correspond to each other.

(4) In one embodiment, in the drive transmission device (2) or (3) described above, the restricting member may be a restricting pin extending in the direction of the rotation axis, the receiving portion may be through holes formed in the bracket portions and the flange portion, and the through holes receive the restricting pin.

(5) In one embodiment, in the drive transmission device of any one of (1) to (4) described above, at least two speed reducers are provided in the first member, the at least two speed reducers are separated from each other in the direction along the rotation axis. The flange portion is provided for each of the at least two speed reducers, and the flange portions are respectively connected to the at least two speed reducers. The bracket portions may be disposed apart from each other in the direction of the rotation axis, and the bracket portions may be disposed between the flange portions adjacent to each other in the direction of the rotation axis.

(6) In one embodiment, in the drive transmission device of any one of (1) to (4) described above, at least two speed reducers are provided in the first member, the at least two speed reducers are separated from each other in the direction along the rotation axis. The flange portion is provided for each of the at least two speed reducers, and the flange portions are respectively connected to the at least two speed reducers. The at least two bracket portions may be disposed apart from each other in the direction of the rotation axis, and the flange portions may be disposed between the bracket portions adjacent to each other in the direction of the rotation axis.

(7) In one embodiment, in the drive transmission device of any one of (1) to (4) described above, at least two speed reducers are provided in the first member, the at least two speed reducers are separated from each other in the direction along the rotation axis. The flange portion is provided for each of the at least two speed reducers, and the flange portions are respectively connected to the at least two speed reducers. The at least two bracket portions may be disposed apart from each other in the direction of the rotation axis, any one of the flange portions may be disposed between the bracket portions adjacent to each other in the direction of the rotation axis, the restricting member may be a restricting pin extending in the direction of the rotation axis, the receiving portion may be through holes formed in the bracket portions and one of the flange portions, and the through holes receive the restricting pin.

(8) A drive transmission device according to another aspect of the disclosure includes: two speed reducers attached to a first member, the first member being coupled to a second member such that the first member is rotatable about a rotation axis; two speed reducers attached to a first member, the first member being coupled to a second member such that the first member is rotatable about a rotation axis; at least two flange portions disposed such that they extend in a direction intersecting the rotation axis, the flange portions respectively connecting the speed reducers and the bracket portions; at least two flange portions disposed such that they extend in a direction intersecting the rotation axis, the flange portions respectively connecting the speed reducers and the bracket portions; and a receiving portion receiving the restricting member. The two speed reducers are attached at positions where are separated from each other in the direction along the rotational axis of the first member, and the two speed reducers synchronously transmit a rotational force from a drive source to the second member. When a region where the bracket portion and the flange portion overlap each other viewed from the direction of the rotation axis is defined as an overlapping region, and the speed reducer, the bracket portion, and the flange portion that are connected to each other are defined as a set, the bracket portion and the flange portion in each set are disposed in the overlapping region. The flange portion and the bracket portion in one set are disposed apart from the flange portion and the bracket portion in the other set in the direction of the rotation axis. The receiving portion is through holes formed in the bracket portions and the flange portions. The restricting member is a restricting pin extending in the direction of the rotation axis. The restricting pin is received in the through holes of the flange portion and the bracket portion in one set and the through holes of the flange portion and the bracket portion in the other set.

With this configuration, the second member can be rotationally driven relative to the first member via the speed reducer, the flange portion, and the bracket portion by the rotational driving force of the drive source. The restricting member and the receiving portion restrict positional movement and posture around the rotation axis while the restricting member and the receiving portion allow a dimensional error in the rotation axis direction between the flange portion and the bracket portion. At the same time, the restricting member and the receiving portion allow relative movement between the bracket portion and the flange portion in the direction along the rotation axis based on the separation distance between the bracket portions in the direction along the rotation axis. Thus, when assembling and connecting the second member and the first member, assembling can be performed simply by aligning the through-holes of the bracket and flange portions as the receiving portion, and inserting and fixing the restricting pin as the restricting member. Therefore, when the second member and the first member are assembled and connected to each other, there is no need to care about dimensional errors in the direction of the rotation axis. There is no need to care about the assembling attitudes of the second member and the first member. Therefore, it is possible to easily assemble the second member and the first member, thereby improving workability. Further, when replacing the second member with respect to the first member, there is no need to care about dimensional errors in the direction of the rotation axis. There is no need to care about the assembling attitudes of the second member and the first member. Therefore, it is possible to easily assemble the second member and the first member, thereby reducing the time which takes for the replacement work and improving the efficiency.

(9) A construction machine according to yet another aspect of the disclosure includes: a first member having a drive source that generates a rotational force; and a second member coupled to the first member via a drive transmission device such that the second member is rotatable about a rotation axis. The drive transmission device includes; a speed reducer provided in the first member at a position close to the second member, the speed reducer transmitting a rotational force from the drive source to the second member; at least two bracket portions provided in the second member at positions close to the first member, the at least two bracket portions being arranged apart from each other in a direction along the rotation axis; a flange portion disposed so as to extend in a direction intersecting the rotation axis, the flange portion connecting the speed reducer and the bracket portions; a flange portion disposed so as to extend in a direction intersecting the rotation axis, the flange portion connecting the speed reducer and the bracket portions; and a receiving portion receiving the restricting member. When a region where the bracket portion and the flange portion overlap each other viewed from the direction of the rotation axis is defined as an overlapping region, the bracket portion and the flange portion are disposed in the overlapping region. The restricting portion and the receiving portion allow movement of the flange portion relative to the bracket portion in the direction of the rotation axis between the two bracket portions adjacent to each other in the rotation axis direction.

According to the above configuration, it is possible to enable rotational drive by the speed reducers and to improve the assembling and replacement workability. As a result, it is easy to provide a construction machine that uses rotary electric actuators.

Advantageous Effects

According to the aspects of the disclosure, it is possible to easily provide a drive transmission device and a construction machine equipped with the drive transmission device that can be assembled without adjusting the installation gap even when the gap size in the direction of the rotation axis is not adjustable due to the installation of speed reducers.

DESCRIPTION OF THE EMBODIMENTS

The following describes a drive transmission device and a construction machine relating to a first embodiment of the disclosure with reference to the accompanying drawings.

<Excavator>

Figure 1:
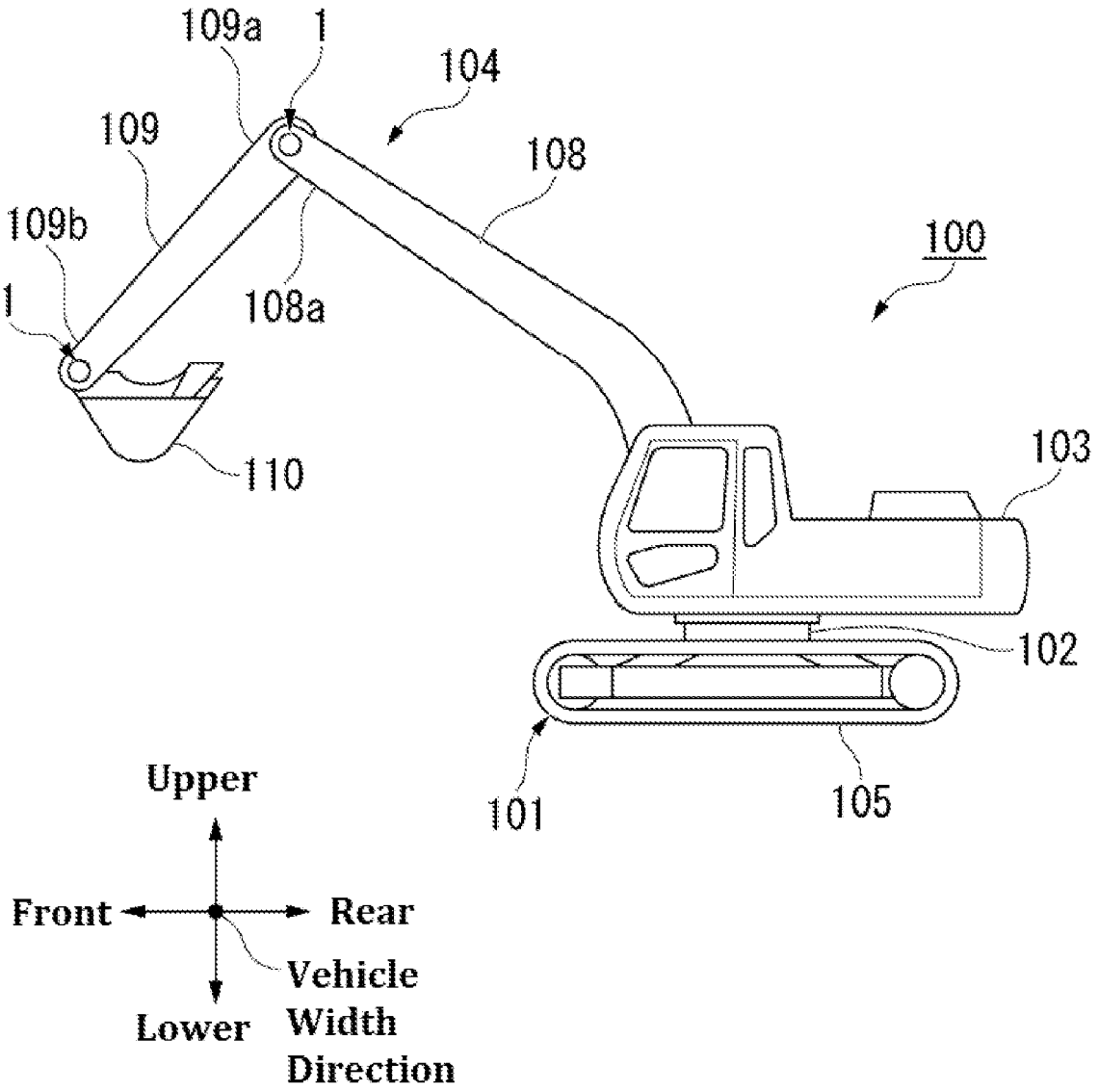
FIG. 1 schematically illustrates a configuration of an excavator according to embodiments of the present disclosure, viewed from the side.

FIG. 1 schematically illustrates an excavator 100, which is an embodiment of a construction machine according to one aspect of the disclosure, viewed from the side. In the following description, a direction to which an operator of the excavator 100 faces is simply referred to as the front. The opposite side to the front in the horizontal direction is referred to as the rear. The upper and lower directions with the excavator 100 placed on a road surface is simply referred to as the vertical direction. A direction orthogonal to the front-rear direction and the vertical direction is referred to as a vehicle width direction. FIG. 1 shows the excavator 100 as viewed from the vehicle width direction.

As shown in FIG. 1, the excavator 100 includes a self-propelled undercarriage 101, a slewable upper structure 103 that is provided on top of the undercarriage 101 via a slewing mechanism 102 and slews or rotates relative to the undercarriage 101, and an operating unit 104 provided on the slewable upper structure 103. The undercarriage 101 and the slewing mechanism 102 are driven, for example, by an unshown electric motor with a reducer. The traveling body 101 includes, for example, two continuous tracks 105 arranged side by side in the vehicle width direction. The configuration of the under carriage 101 is not limited to the continuous tracks 105. Wheels or the like may be used instead of the continuous tracks 105.

The operating unit 104 includes a boom 108 and arm 109 extending in the front-rear direction, and a bucket 110. The boom 108, the arm 109, and the bucket 110 are rotatably connected to each other via drive transmission devices 1. One end of the boom 108 in the longitudinal direction is rotatably coupled to the slewable upper structure 103 via the drive transmission device 1 (one end of the boom 108 in the longitudinal direction and the drive transmission device 1 provided at the one end of the boom 108 are not shown in FIG. 1). One end 109*a* of the arm 109 in the longitudinal direction is rotatably coupled to the other end 108*a* of the boom 108 in the longitudinal direction via the drive transmission device 1. The bucket 110 is rotatably coupled to the other end 109*b* of the arm 109 in the longitudinal direction via the drive transmission device 1. The drive transmission devices 1 provided in the coupling portions all have the same configuration. Therefore, in the following description, only the drive transmission device 1 that couples the bucket 110 to the other end 109*b* in the longitudinal direction of the arm 109 will be described, and description of the other drive transmission devices 1 will be hereunder omitted.

Figure 2:
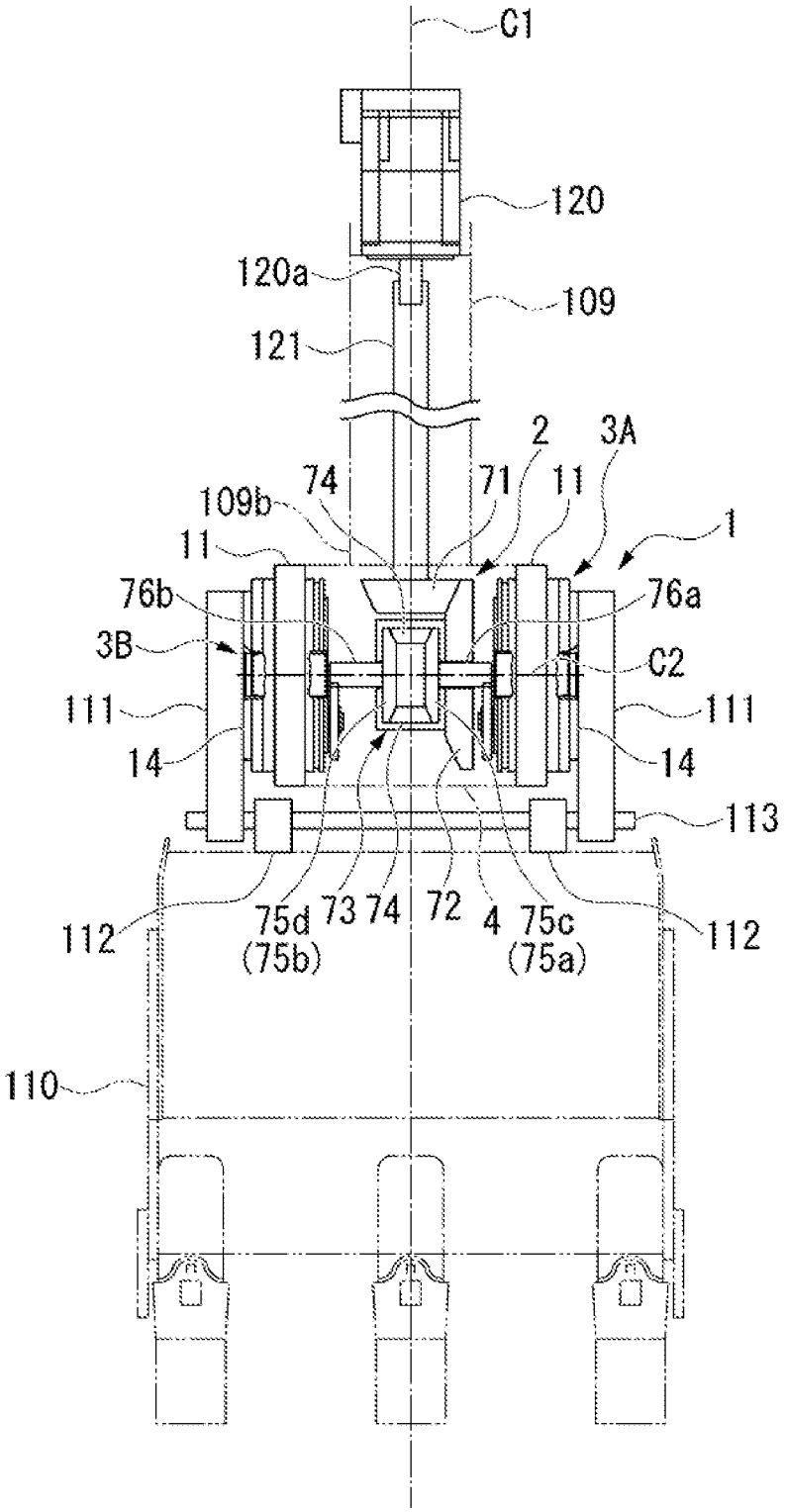
FIG. 2 schematically illustrates a drive transmission device in detail in a coupling portion between an arm and a bucket in a first embodiment of the disclosure.

FIG. 2 schematically illustrates the coupling portion between the arm 109 and the bucket 110 in detail. In FIG. 2, the arm 109 and the bucket 110 (except a bracket 112) are shown by a dashed-two dotted line for the sake of clarity. As shown in FIG. 2, the arm 109 includes a motor 120 (an example of the drive source or motor in the claims) installed therein. The rotational force of the motor 120 is transmitted to the bucket 110 via the drive transmission device 1. That is, the arm 109 is an example of the first member in the claims. The bucket 110 is an example of the second member in the claims.

The motor 120 is, for example, a so-called electric motor. The motor 120 is driven by electric power of an external power source (battery) provided in, for example, the slewable upper structure 103. The motor 120 may be a so-called brushed motor, a brushless motor or the like. Various electric motors driven with electric power can be adopted as the motor 120. The motor 120 is disposed such that a motor shaft 120*a* rotatable about a first rotation axis C1 faces the bucket 110. The first rotation axis C1 of the motor shaft 120*a* and the longitudinal direction of the arm 109 coincide with each other.

First Embodiment

<Drive Transmission Device>

The drive transmission device 1 is disposed on the second rotation axis C2 (an example of the rotation axis in the claims) of the bucket 110 relative to the arm 109. The bucket 110 is connected to the arm 109 via the drive transmission device 1 and rotates about the second rotation axis C2 relative to the arm 109.

The drive transmission device 1 includes a differential unit 2, two speed reducers 3A and 3B (first speed reducer 3A and second speed reducer 3B), a flange portion 111, a restricting pin (restricting member) 113, and an attachment bracket (bracket portion) 112. The differential unit 2 is housed in a housing 4 fixed to the other end 109*b* of the arm 109. The differential unit 2 is flanked by the two speed reducers 3A, 3B. The differential unit 2 is coupled to the two speed reducers 3A, 3B. The speed reducers 3A, 3B are flanked by the flange portions 111 on the second rotation axis C2. The restricting pins 113 extend along the second rotation axis C2 and penetrate the flange portions 111 at a position proximate to the bucket 110. The attachment brackets 112 are penetrated by the restricting pins 113.

Rotation axes of the two speed reducers 3A and 3B are parallel to the second rotation axis C2. In the following description, the direction parallel to the second rotation axis C2 may be referred to as an axial direction, the circumferential direction of the second rotation axis C2 may be referred to as a circumferential direction, and the direction orthogonal to the axial direction and the circumferential direction may be referred to as a radial direction. One set of the flange portion 111, the restricting pin 113, and the attachment bracket 112 is fixed to the speed reducer 3A. Another set of the flange portion 111, the restricting pin 113, and the attachment bracket 112 is fixed to the speed reducer 3B. In other words, the flange portions 111 are connected to the speed reducers 3A, 3B, respectively. The rotation of the motor 120 is transmitted to the two speed reducers 3A and 3B, the flange portions 111, the restricting pins 113, and the attachment brackets 112, thereby the bucket 110 is rotated around the second rotation axis C2 relative to the arm 109.

Figure 3:
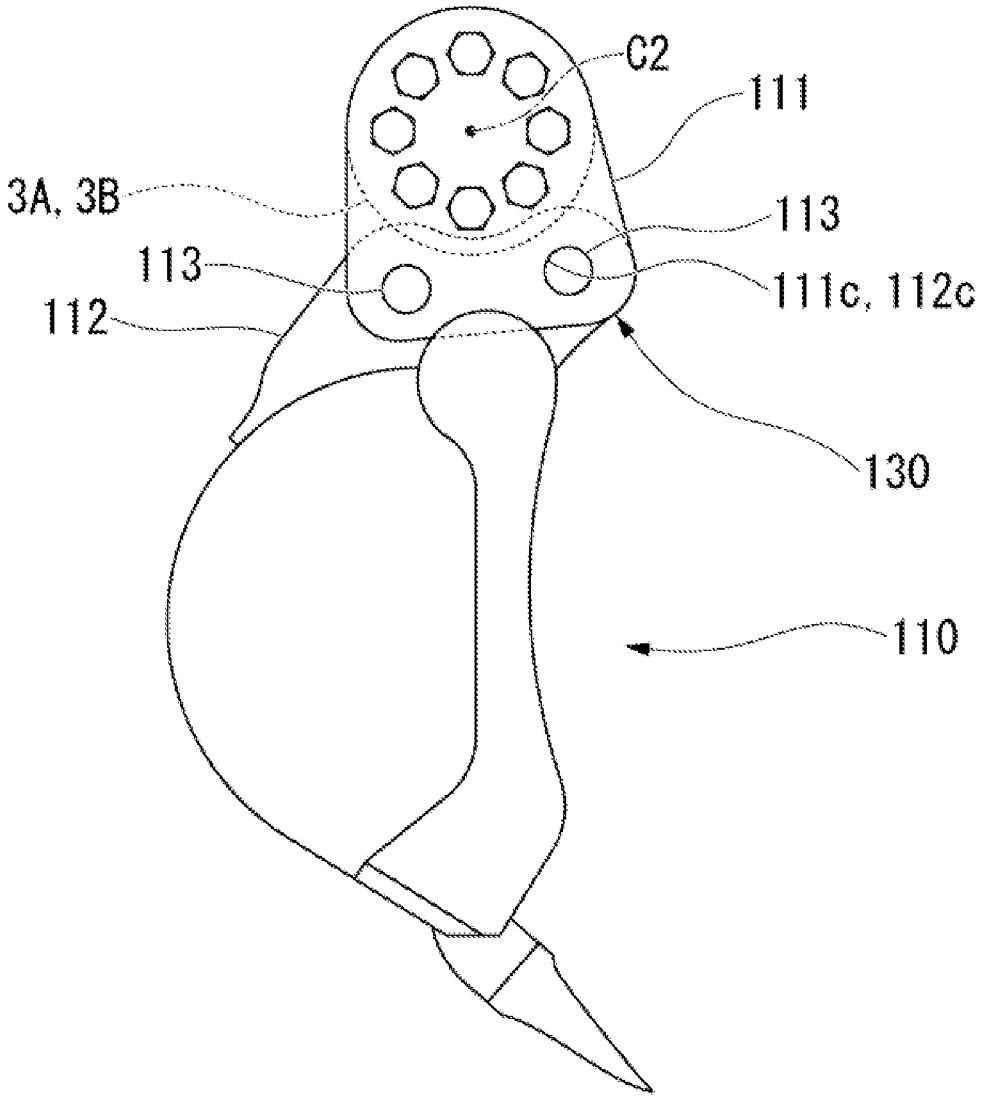
FIG. 3 schematically illustrates an overlapping region in the first embodiment of the present disclosure, viewed from the side.

FIG. 3 schematically illustrates an overlapping region of the coupling portion between the arm 109 and the bucket 110 when viewed in the direction along the second rotation axis C2. As shown in FIG. 3, the drive transmission device 1 has the overlapping region 130 where the flange portion 111 and the bracket portion 112 overlap each other at a position between the arm 109 and the bucket 110 when viewed in the direction along the second rotation axis C2.

A portion of the flange portion 111 in the overlapping region 130 has two through holes 111*c* that penetrate the flange portion 111 in the direction along the second rotation axis C2. A portion of the attachment bracket 112 in the overlapping region 130 has two through holes 112*c* that penetrate the attachment bracket 112 in the direction along the second rotation axis C2. The through holes 111*c* of the flange portion 111 and the through holes 112*c* of the attachment bracket 112 are respectively formed at the corresponding positions viewed in the direction along the second rotation axis C2. The restricting pins 113 penetrate the through holes 111*c* of the flange portion 111 and the through holes 112*c* of the attachment bracket 112 respectively.

The restricting pin 113 extends in a direction along the second rotation axis C2 and is configured as a restricting member that restricts relative rotational movement between the flange portion 111 and the mounting bracket 112 about the second rotation axis C2. The through hole 111*c* and the through hole 112*c* are configured as receiving portions to receive the restricting pin 113.

In this embodiment, more than one set of the through hole 111*c* and through hole 112*c* as the receiving portions and the restricting pin 113 as the restricting member is provided around the rotation axis (with the rotation axis as the center), specifically two sets are provided. More than two sets of the receiving portions and the restricting member may be provided. Each set of the receiving portions and the restricting member is disposed apart from each other in the circumferential direction of the second rotation axis C2. Alternatively, each set of the receiving portions and the restricting member may be disposed apart from each other in the radial direction of the second rotation axis C2. In this embodiment, the two attachment brackets 112 are disposed between the two flange portions 111. The restricting pin 113, the through hole 111*c* and through hole 112*c* allow axial movement of the bucket 110 relative to the drive transmission device 1 only for the gaps between the two flange portions 111 and the attachment brackets 112.

As shown in FIG. 3, the through hole 111*c* and the through hole 112*c* serving as the receiving portions have a round sectional shape in the direction intersecting the second rotation axis C2. As shown in FIG. 3, the restricting pin 113 has a substantially round sectional shape, which is a substantially circle as viewed in the direction intersecting the second rotation axis C2. The cross-sectional shape of the restricting pin 113 and the cross-sectional shapes of the through hole 111*c* and through hole 112*c* are substantially identical. The restricting pin 113 will be later described in detail.

Figure 4:
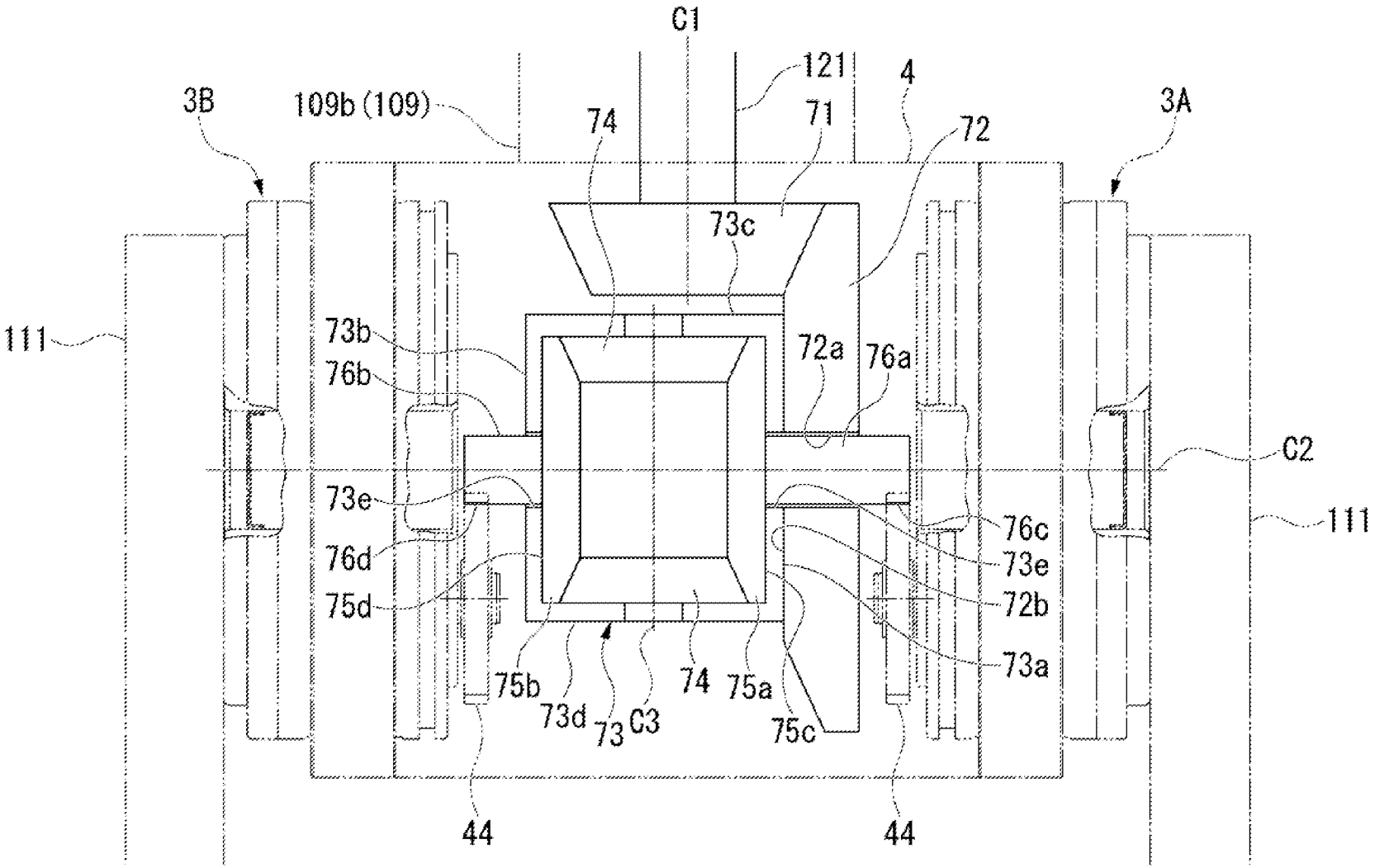
FIG. 4 schematically illustrates a configuration of a differential unit in the first embodiment.

FIG. 4 schematically shows the configuration of the differential unit 2. The differential unit 2 is coupled to the motor shaft 120*a* via a transmission shaft 121. The differential unit 2 is provided at an end of the transmission shaft 121 opposite to the motor 120. The differential unit 2 includes a first bevel gear 71 that rotates about the first rotation axis C1, a second bevel gear 72 meshed with the first bevel gear 71, a differential case 73 fixed to the second bevel gear 72, a pinion gear 74 rotatably supported by the differential case 73 such that it protrudes from the differential case 73, and a pair of side gears 75*a* and 75*b* (first side gear 75*a*, second side gear 75*b*) meshed with the pinion gear 74.

The second bevel gear 72 rotates about the second rotation axis C2. An insertion hole 72*a* is formed in the radial center of the second bevel gear 72. The insertion hole 72*a* receives a first operation output shaft 76*a*. The differential case 73 is fixed to an end surface 72*b* of the second bevel gear 72 facing the first bevel gear 71. The differential case 73 is formed in a square frame shape. The differential case 73 includes two side surfaces 73*a* and 73*b* (first side surface 73*a* and second side surface 73*b*) opposed to each other in the axial direction, and two side surfaces 73*c* and 73*d* (third side surface 73*c* and fourth side surface 73*d*) opposed to each other and their planar direction are orthogonal to the planar direction of the side surfaces 73*a* and 73. Of the four side surfaces 73*a* to 73*d*, the outer side of the first side surface 73*a* is fixed to the end surface 72*b* that faces the first bevel gear 71.

A pinion gear 74 is respectively provided on the third side surface 73*c* and the fourth side surface 73*d*. The pinion gear 74 is supported by the side surfaces 73*c* and 73*d* rotatably about the third rotation axis C3 that extends orthogonal to the axial direction. The pinion gear 74 is also rotatable together with the differential case 73 about the second rotation axis C2.

The pinion gear 74 is flanked by the pair of side gears 75*a* and 75*b*. That is, of the pair of side gears 75*a* and 75*b*, the first side gear 75*a* is disposed along the first side surface 73*a* in the differential case 73. The first side gear 75*a* is disposed coaxially with the second rotation axis C2. Of the pair of side gears 75*a* and 75*b*, the second side gear 75*b* is disposed coaxially with the second rotation axis C2 in the differential case 73. The second side gear 75*b* is disposed coaxially with the second rotation axis C2.

One end of the first operation output shaft 76*a* is provided on the end surface 75*c* of the first side gear 75*a* facing the first side surface 73*a*. The first operation output shaft 76*a* is arranged coaxially with the second rotation axis C2. The other end of the first operation output shaft 76*a* extends through the insertion hole 73*e* formed in the first side surface 73*a* and the insertion hole 72*a* of the second bevel gear 72 and protrudes out. That is, the first side gear 75*a* is rotatably supported by the first side surface 73*a* of the differential case 73. At the other end of the first operation output shaft 76*a*, a teeth portion 76*c* that meshes with the first speed reducer 3A is formed on the outer peripheral surface.

One end of the second operation output shaft 76*b* is provided on the end surface 75*d* of the second side gear 75*b* facing the second side surface 73*b*. The second operation output shaft 76*b* is arranged coaxially with the second rotation axis C2. The other end of the second operation output shaft 76*b* extends through the insertion hole 73*e* formed in the second side surface 73*b* and protrudes out. That is, the second side gear 75*b* is rotatably supported by the second side surface 73*b* of the differential case 73. At the other end of the second operation output shaft 76*b*, a teeth portion 76*d* that meshes with the second speed reducer 3B is formed on the outer peripheral surface. As described above, the operation output shafts 76*a* and 76*b* form a part of the speed reducers 3A and 3B respectively connected to the differential unit 2.

<Speed Reducer>

Figure 5:
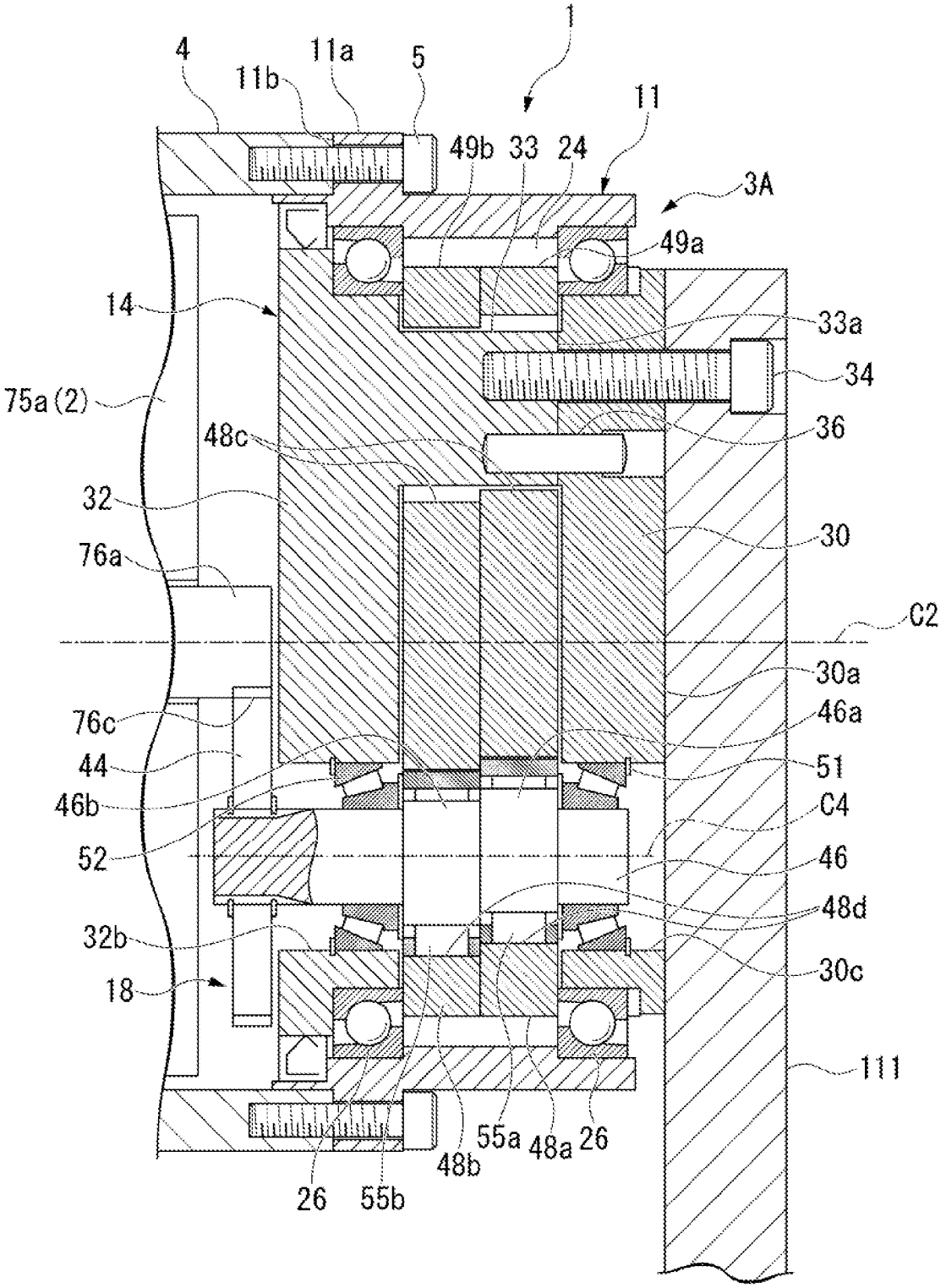
FIG. 5 schematically illustrates a configuration of a speed reducer in the first embodiment.

FIG. 5 schematically shows the configuration of the first speed reducer 3A. The configurations of the two speed reducers 3A and 3B are the same. The two speed reducers 3A and 3B are arranged symmetrically with respect to the third rotation axis C3. Therefore, in the following description, only the first speed reducer 3A will be described, and description of the second speed reducer 3B will be hereunder omitted. As shown in FIG. 5, the first speed reducer 3A includes a cylindrical casing 11, a carrier 14 disposed radially inside the casing 11, and a speed reducer output portion 18 that rotates the carrier 14 at a rotation speed reduced at a predetermined ratio with respect to the rotation speed of the first operation output 76*a*.

<Casing>

An outer flange portion 11*a* projecting outward in the radial direction is integrally formed with the outer circumferential surface of the casing 11. The outer flange portion 11*a* has a rectangular section along the axial direction. The housing 4 abuts the end surface 11*b* of the outer flange portion 11*a* facing the differential unit 2 (left side in FIG. 4). The housing 4 is fastened and fixed to the outer flange portion 11*a* by bolts 5. Internal teeth 24 are provided on an inner circumferential surface of the casing 11. The internal teeth 24 are pin-shaped (cylindrical) teeth provided on an inner peripheral surface of the case 11. Two or more internal teeth 24 are arranged at equal intervals in the circumferential direction.

<Carrier>

More specifically, the carrier 14 is rotatably supported by the casing 11 via a pair of main bearings 26 (one example of the bearings in the claims) disposed at a distance from each other in the axial direction of the casing 11. The main bearing 26 is, for example, an angular contact ball bearing. The carrier 14 is situated on the same axis as the casing 11 and the second rotation axis C2.

The carrier 14 includes an end plate portion 30 disposed away from the differential unit 2, and three cylindrical pillar portions 33 that are integrally molded with the base plate portion 32 and protrude out from the base plate portion 32 toward the end plate portion 30. The pillar portions 33 are arranged at equal intervals in the circumferential direction. The end plate portion 30 is disposed at tips 33*a* of the pillar portions 33. The flange portion 111 is disposed on a surface 30*a* of the end plate portion 30 facing away from the base plate portion 32. The end plate portion 30 and the flange portion 111 are fastened and fixed to the pillar portions 33 by bolts 34. In this state, a space having a predetermined width in the axial direction is formed between the base plate portion 32 and the end plate portion 30. In other words, the flange portions 111 are connected to the speed reducers 3A, 3B, respectively.

A pin 36 is provided slightly inner in the radial direction than the bolt 34 in the pillar portion 33. The pin 36 is provided for positioning the end plate portion 30 with respect to the base plate portion 32. The pin 36 is disposed such that it spans the pillar portion 33 and the end plate portion 30. The pillar portion 33 and the base plate portion 32 are not necessary formed integrally with each other. In this case, the pillar portion 33 is fastened to the base plate portion 32. The configuration of the pillar portions 33 is not limited to such a columnar shape. The pillar portions 33 may be formed in any shape or configuration provided that they form a space having a certain width in the axial direction between the base portion 32 and the end plate portion 30.

A plurality of (for example, three in this embodiment) through holes 30*c* are formed in the end plate portion 30. A plurality of (for example, three in this embodiment) through holes 32*b* are formed in the base plate portion 32. The crank shaft 46 of the speed reducer output portion 18 is inserted into the through holes 30*c* and 32*b*. The through holes 30*c* and through holes 32*b* are arranged at equal intervals in the circumferential direction.

<Speed Reducer Output Portion>

The speed reducer output portion 18 includes two or more transmission gears 44 (for example, three in this embodiment) that mesh with the teeth portion 76*c* of the first operation output shaft 76*a*, two or more crankshafts 46 (three in this embodiment) having one end fixed to the transmission gear 44, a first external gear 48*a* (an example of the external teeth member in the claims) and a second external gear 48*b* (an example of the external teeth member in the claims) that oscillatory rotate with the rotation of the crankshaft 46.

Since the transmission gears 44 are fixed to one end of the crankshafts 46, the rotation of the first operation output shaft 76*a* is transmitted to the crankshaft 46 via the transmission gear 44. The crankshafts 46 are arranged extending along the axial direction. In other words, the crankshaft 46 rotates on a crank rotation axis C4 (an example of the other rotation axis in the claims) parallel to the second rotation axis C2. The crankshaft 46 is rotatably supported by the end plate portion 30 via a first crank bearing 51. The crankshaft 46 is rotatably supported on the base plate portion 32 via a second crank bearing 52. The first crank bearing 51 and the second crank bearing 52 are, for example, tapered roller bearings.

At the center of the crankshaft 46 in the axial direction, a first eccentric portion 46*a* and a second eccentric portion 46*b* disposed eccentrically from the axial center of the crankshaft 46 are provided. The first and second eccentric portions 46*a*, 46*b* are disposed adjacent to each other in the axial direction between the first crank bearing 51 and the second crank bearing 52. The first eccentric portion 46*a* is disposed adjacent to the first crank bearing 51. The second eccentric portion 46*b* is disposed adjacent to the second crank bearing 52. The first eccentric portion 46*a* and the second eccentric portion 46*b* are out of phase with each other. These crankshafts 46 are each inserted into the through hole 30*c* in the end plate portion 30 and the through hole 32*b* in the base plate portion 32. That is, the crankshafts 46 are also arranged at equal intervals in the circumferential direction like the through holes 30*c* and 32*b*.

A first roller bearing 55*a* is attached to the first eccentric portion 46*a* of the crankshaft 46. A second roller bearing 55*b* is attached to the second eccentric portion 46*b*. The first roller bearing 55*a* is, for example, a cylindrical roller bearing. The first roller bearing 55*a* includes a plurality of rollers 56 and a cage 57 for holding the plurality of rollers 56. Since the second roller bearing 55*b* has the same configuration as the first roller bearing 55*a*, detailed description thereof will be omitted. The first external gear 48*a* and the second external gear 48*b* are oscillatory rotated in conjunction with the rotation of the crankshaft 46 via the roller bearings 55*a* and 55*b*.

The first and second external gears 48*a*, 48*b* are disposed in a space between the base plate portion 32 of the carrier 14 and the end plate portion 30. The first external gear 48*a* and the second external gear 48*b* have external teeth 49*a* and 49*b* respectively that mesh with the internal teeth 24 of the casing 11. In the first external gear 48*a* and the second external gear 48*b*, formed are a first through hole 48*c* into which the pillar portion 33 is inserted, and second through holes 48*d* into which the eccentric portions 46*a* and 46*b* of the crankshaft 46 are inserted.

The first eccentric portion 48*a* of the crankshaft 46 and the first roller bearing 55*a* are inserted into the second through hole 48*d* of the first external gear 48*a*. The second eccentric portion 46*b* of the crankshaft 46 and the second roller bearing 55*b* are inserted into the second through hole 48*d* of the second external gear 48*b*. The first eccentric portion 46*a* and the second eccentric portion 46*b* are oscillatory rotated by the rotation of the crankshaft 46, and thus the first external gear 48*a* and the second external gear 48*b* are oscillatory rotated while they mesh with the internal teeth 24 of the casing 11.

<Operation of Drive Transmission Device>

Next, a description is given of an operation of the drive transmission device 1. When the motor 120 provided in the arm 109 is driven, the rotation of the motor shaft 120*a* is transmitted to the first bevel gear 71 in the drive transmission device 1 via the transmission shaft 121. The second bevel gear 72 that meshes with the first bevel gear 71 is rotated as the first bevel gear 71 rotates. The differential case 73 fixed to the second bevel gear 72 is rotated as the second bevel gear 72 rotates. The pinion gear 74 is thus rotated about the second rotation axis C2. As a result, the pair of side gears 75*a*, 75*b* meshing with the pinion gear 74 are rotated.

Of the pair of side gears 75*a*, 75*b*, the rotation of the first side gear 75*a* is transmitted to the first speed reducer 3A via the first operation output shaft 76*a*. Of the pair of side gears 75*a*, 75*b*, the rotation of the second side gear 75*b* is transmitted to the second speed reducer 3B via the second operation output shaft 76*b*. The operation of the first speed reducer 3A among the two speed reducers 3A and 3B will be now described.

The transmission gear 44 that meshes with the first operation output shaft 76*a* is rotated by the rotation of the first operation output shaft 76*a*. Thus, the crankshaft 46 is integrally rotated with the transmission gear 44 about the crank rotation axis C4. When the crankshaft 46 is rotated, the first external gear 48*a* is rotated while meshing with the internal teeth 24 as the first eccentric portion 46*a* oscillatory moves. As the second eccentric portion 46*b* oscillatory moves, the second external gear 48*b* is rotated while meshing with the internal teeth 24. That is, the crankshaft 46 rotates on the crank rotation axis C4 and revolves around the second rotation axis C2.

In the present embodiment, the pillar portion 33 penetrating the first through hole 48*c* of the external gears 48*a* and 48*b* is fixed in a predetermined position together with the base plate portion 32. As a result, the carrier 14 is rotated about the second rotation axis C2 relative to the casing 11 at a rotation speed slower than that of the first operation output shaft 76*a*. The other end 109*b* of the arm 109 is fixed to the casing 11 via the housing 4. The flange portion 111 is fixed to the end plate portion 30 of the carrier 14. The through hole 111*c* of the flange portion 111 receives the restricting pin 113. The through hole 112*c* of the attachment bracket 112 also receives the restricting pin 113.

The through-hole 111*c*, through-hole 112*c*, and restricting pin 113 are provided in two sets such that the two sets are separated from each other around the second rotation axis C2. Thus, by driving the motor 120 provided in the arm 109, the bucket 110 is rotationally moved about the second rotation axis C2 relative to the arm 109.

In this embodiment, the drive transmission device 1 includes the two speed reducers 3A and 3B that decelerate and the rotation of the motor 120 and outputs the decelerated rotation. The arrangement of the two speed reducers 3A and 3B in the direction along the second rotation axis C2 is fixed <Assembling of Drive Transmission Device>

Figure 6:
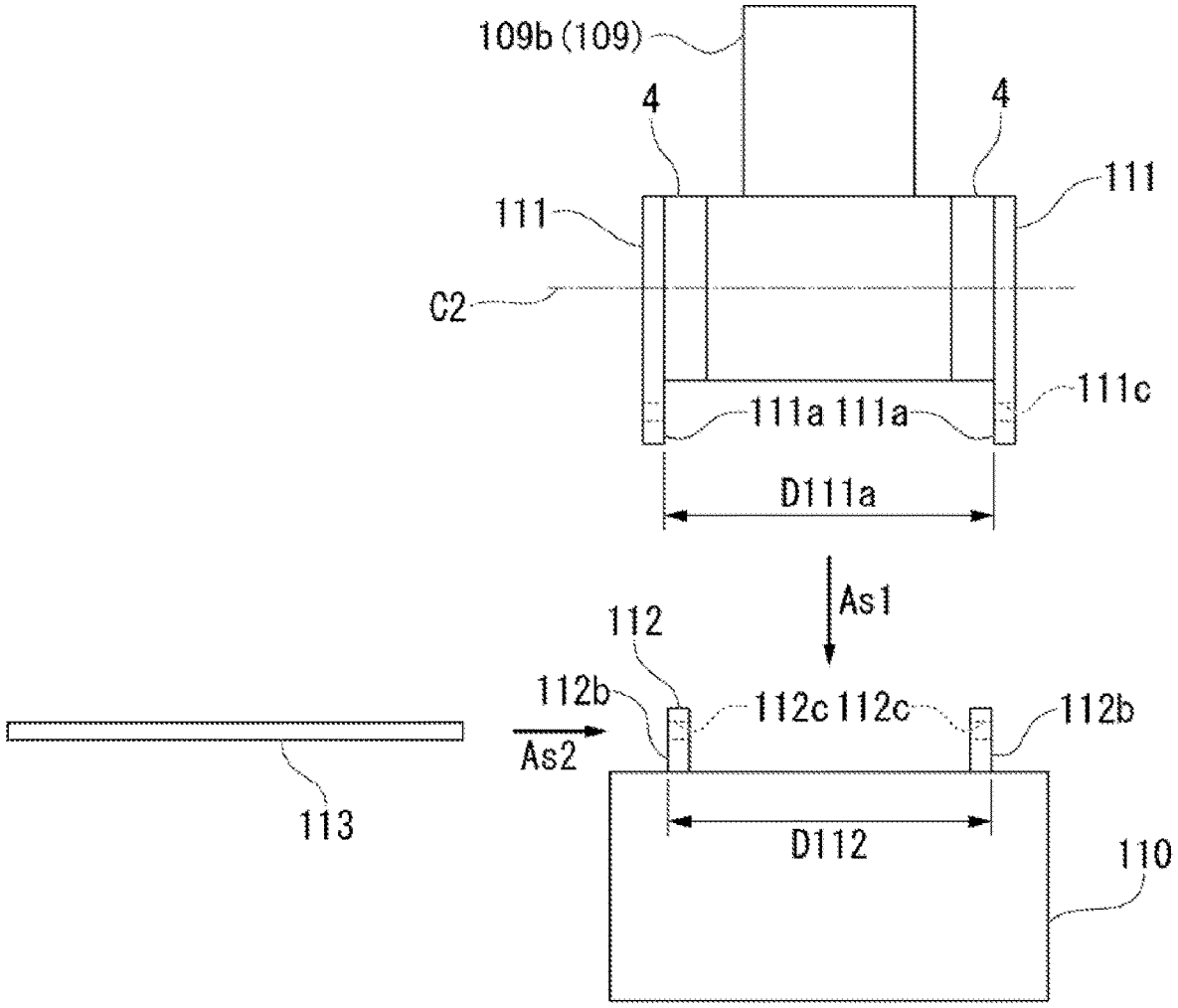
FIG. 6 is an exploded configuration diagram showing dimensions and assembling process of the drive transmission device in the first embodiment of the disclosure.

Next, the dimensions and assembling process of the drive transmission device 1 will be described. FIG. 6 is an exploded configuration diagram of the drive transmission unit 1 for describing its dimensions and assembling process. In the drive transmission device 1, a distance D112 between the outer surfaces 112*b* of the two attachment brackets 112 in the direction along the second rotation axis C2 is approximately the same or smaller than a distance D111*a* between the opposing surfaces 111*a* of the two flange portions 111 in the direction along the second rotation axis C2. By setting the distance D111*a* and the separation distance D112 as described above, the attachment brackets 112 can be easily inserted between the flange portions 111 when the arm 109 and the bucket 110 are connected.

In the assembling process of the drive transmission device 1, the arm 109 and the bucket 110 are brought close to each other as indicated by the arrow As1 in FIG. 6, and the attachment brackets 112 are easily inserted between the flange portions 111. At this time, the arm 109 and the bucket 110 are brought close to each other until the two sets of the through holes 111*c* and the through holes 112*c* coincide with each other when viewed in the direction along the second rotation axis C2. At this time, the axes of the two sets of the through holes 111*c* and the through holes 112*c* are aligned with each other.

Next, the restricting pin 13 is inserted in the two sets of the through holes 111*c* and through holes 112*c* as indicated by the arrow As2 in FIG. 6. Further, the restricting pin 13 is fixed to prevent the restricting pin 13 from moving in the direction along the second rotation axis C2, and the assembling of the drive transmission device 1 is completed.

Thus, in the assembling of the drive transmission device 1, the bucket 110 can be connected such that the speed reducers 3A, 3B rotatably drive the bucket 110 by connecting the flange portions 111 and the attachment brackets 112 with the restricting pin 113, even though the flange portions 111 and the attachment brackets 112 both have fixed separation distances in the direction of the rotation axis C2. Here, with the two restricting pins 113, the bucket 110 can be connected to the flange portions 111 such that the bucket 110 is unrotatable about the rotation axis C2.

Figure 7:
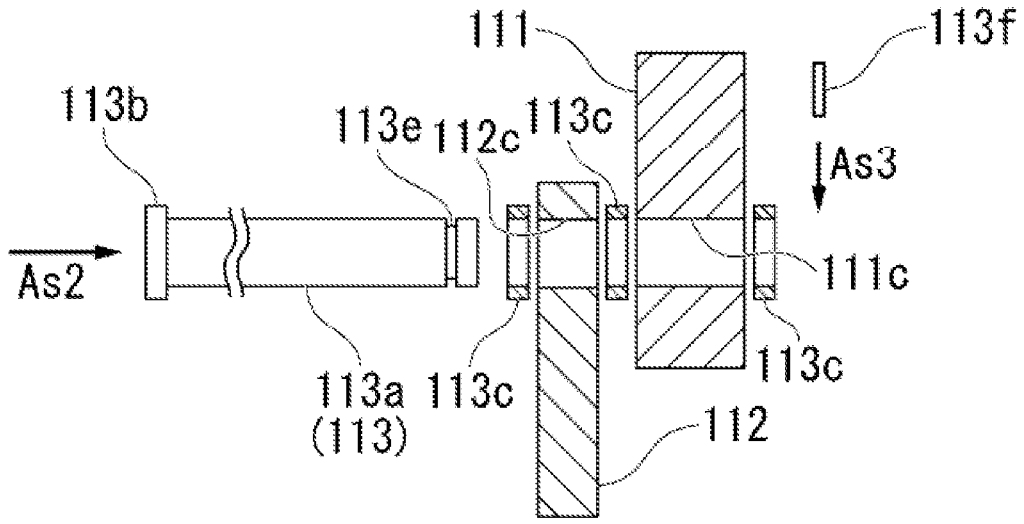
FIG. 7 is an exploded configuration diagram showing assembling process for restricting member in the first embodiment of the present disclosure.

FIG. 7 is an exploded configuration diagram showing the assembling process of the restricting pin, the flange portion, and the attachment bracket in the drive transmission device 1. The restricting pin 13 has an uniform cylindrical portion 113*a* whose diameter substantially corresponds to the diameters of the through hole 111*c* and the through hole 112*c*, a radially enlarged portion 113*b* provided at one end of the cylindrical portion 113*a*, and a fixed receiving portion 113*e* provided at the other end of the cylindrical portion 113*a*. The fixed receiving portion 113*e* has a smaller diameter than the cylindrical portion 113*a*. The restricting pin 13 includes a fixing portion 113*f*. The fixing portion 113*f* is fitted into the fixed receiving portion 113*e* and is restricted from moving in the second rotation axis C2 direction of the restricting pin 113 and coming out of the through hole 111*c* and the through hole 112*c*. The fixed portion 113*f* may be formed in a C-ring shape, a U-shape corresponding to the fixed receiving portion 113*e*, or a plate having a notch.

Figure 8:
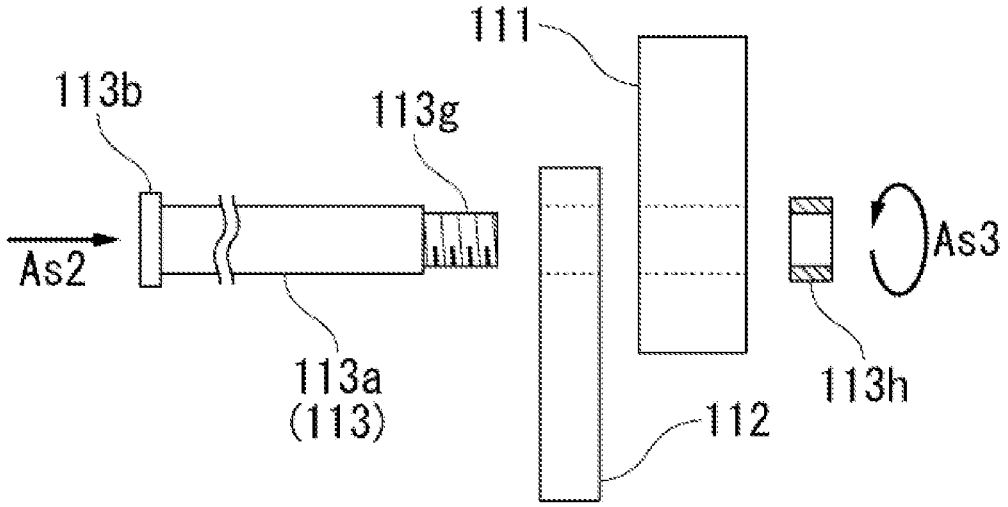
FIG. 8 is an exploded configuration diagram showing another example of the restricting member in the first embodiment of the present disclosure.

The restricting pin 13 may be a fixing pin whose fixing portion 113 is inserted in a hole having an axis in the radial direction of the cylindrical portion 113*a* as the fixing receiving portion 113*e*. FIG. 8 is an exploded configuration diagram showing another example of the assembling process of the restricting pin, the flange portion, and the attachment bracket in the drive transmission device 1. As shown in FIG. 8, the restricting pin 13 may be provided with a male screw portion 113*g* (fixed receiving portion) at the other end of the cylindrical portion 113*a*. The restricting pin 13 may be configured to fasten the male screw portion 113*g* to a nut (fixing portion) 113*h*.

Fixing with the restricting pin 113 in the assembly process of the drive transmission device 1 will be described. In the final step of the assembling process of the drive transmission device 1, when the restricting pin 113 is inserted into the through hole 111*c* and the through hole 112*c* in the second rotation axis C2 direction as indicated by the arrow As2 in FIGS. 7 and 8, the restricting pin 113 is inserted is the through hole 111*c* and the through hole 112*c* such that a member 113*c* is located between the flange portion 111 and the attachment bracket 112. Next, as indicated by the arrow As3 in FIGS. 7 and 8, the other end of the cylindrical portion 113*a* is fixed by the fixing portion 113*f* or the nut (fixing portion) 113*h* such that the it does not move in the second rotation axis C2 direction. One end of the cylindrical portion 113*a* is fixed by the radially enlarged portion 113*b* to prevent it from moving in the second rotation axis C2 direction.

Figure 9:
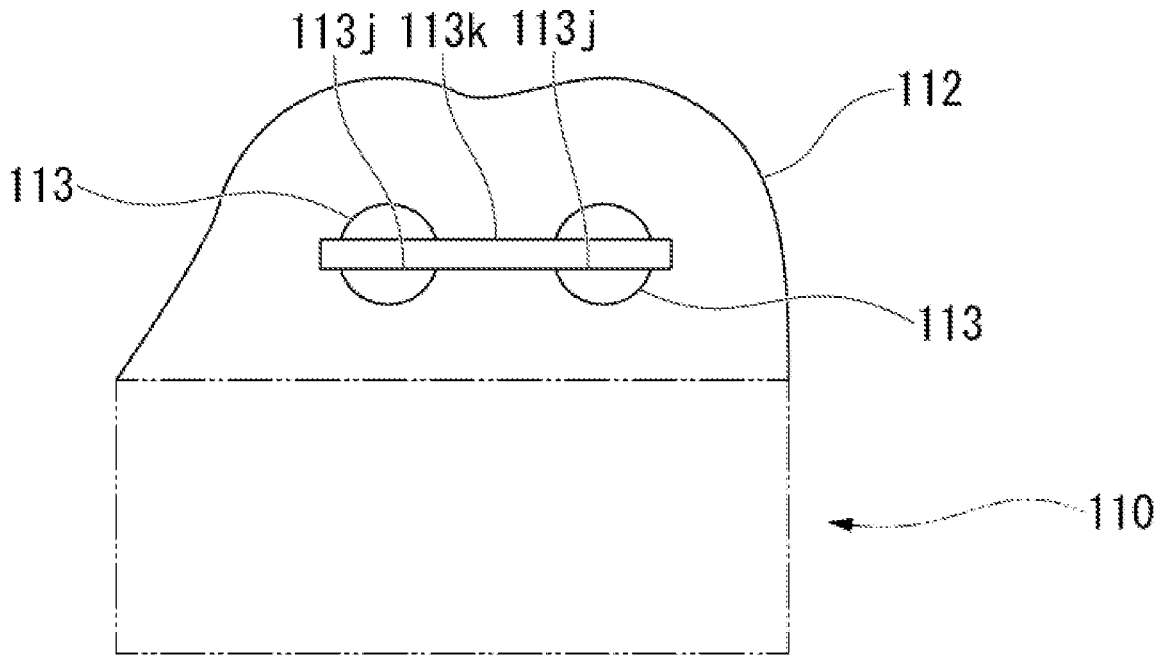
FIG. 9 is an exploded configuration diagram showing yet another example of the restricting member in the first embodiment of the present disclosure viewed from the side.

FIG. 9 is an exploded configuration diagram showing another example of the assembling process of the restricting pin, the flange portion, and the attachment bracket in the drive transmission device 1. As shown in FIG. 9, taps 113*j* are formed on the end surface of the two restricting pins 113. A plate 113*k* that serves as a fixing part may be inserted into the taps 113*j* at the same time. As the fixing part, a U-shaped fixing member may be used instead of the plate 113*k*.

In the first embodiment, the flange portions 111 are connected from the outer sides of the two speed reducers 3A and 3B in the second rotation axis C2 direction, and the bucket 110 is connected with the attachment brackets 112 by placing them in the area between the inner sides of the flange portions 111 in the second rotation axis C2. In this way, the bucket 110 is attached such that it is rotatable by the two speed reducers 3A and 3B, and at the same time, a dimensional error can be absorbed between the flange portions 111 and the attachment brackets 112. Therefore, it is not necessary to prepare and provide an extra spacer or the like, and the drive transmission device 1 can be easily assembled with a simple configuration.

Figure 10:
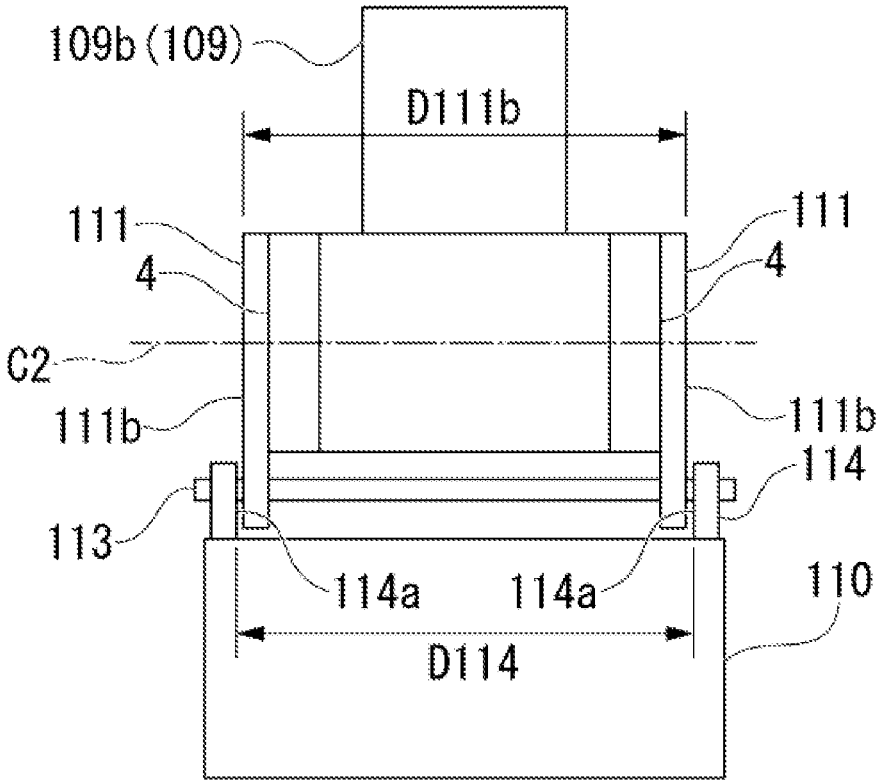
FIG. 10 schematically illustrates dimensions and assembled state of a drive transmission device in a second embodiment of the present disclosure.

A drive transmission device and a construction machine relating to a second embodiment of the disclosure will be now described with reference to the accompanying drawings. FIG. 10 schematically illustrates dimensions and assembled state of the drive transmission device in the second embodiment of the disclosure. The second embodiment is different from the first embodiment in terms of the attachment bracket (bracket portion). Except for the attachment bracket, the same reference numerals are given to elements corresponding to those of the first embodiment and the description thereof will not be repeated.

In the second embodiment, as shown in FIG. 10, two attachment brackets 114 are formed on the bucket 110. The two attachment brackets are separated from each other in the second rotation axis C2 direction. Facing surfaces 114*a* of the brackets 114 facing in the second rotation axis C2 direction are separated by a distance D114 in the second rotation axis C2 direction. The distance D114 is larger than a distance D111*b* between the outer surfaces 111*b* of the two flange portions 111, which is different from the first embodiment. In the second embodiment, the two attachment brackets 114 are connected by the restricting pin(s) 113 such that the two brackets 114 are situated on the outer sides of the two flange portions 111 respectively in the second rotation axis C2 direction. That is, the two flange portions 111 are disposed between the two attachment brackets 114.

This embodiment produces the same effects as the first embodiment described above.

Figure 11:
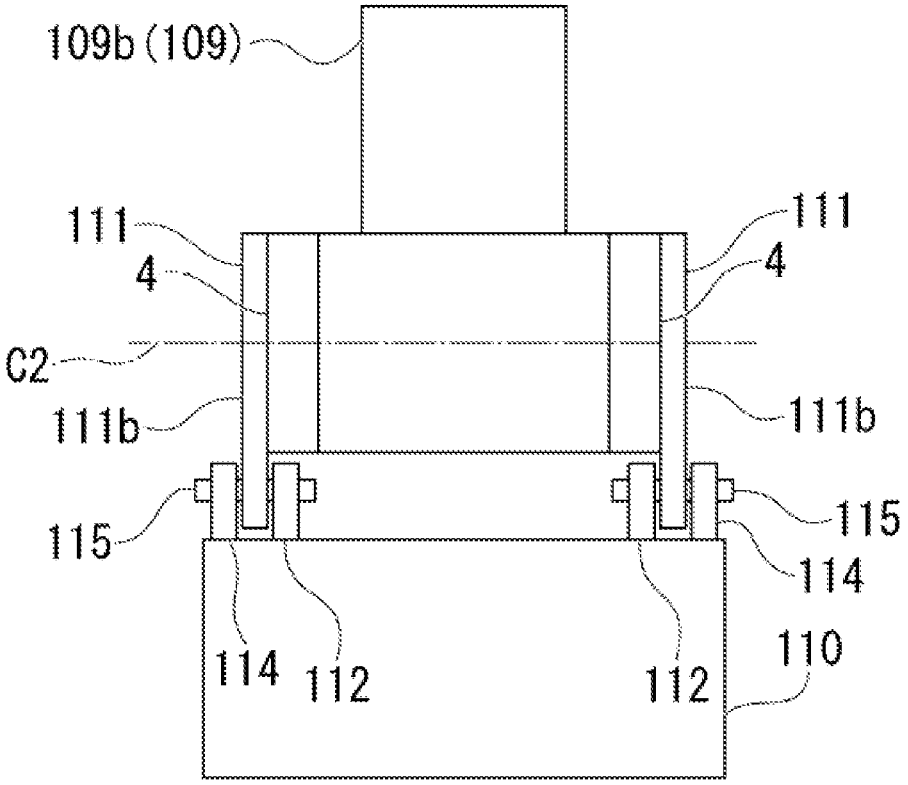
FIG. 11 schematically illustrates the assembled state of a drive transmission device in a third embodiment of the present disclosure.

A drive transmission device and a construction machine relating to a third embodiment of the disclosure will be now described with reference to the accompanying drawings. FIG. 11 schematically illustrates an assembled state of the drive transmission device in the third embodiment of the disclosure. The third embodiment is different from the first and second embodiments in terms of the attachment bracket (bracket portion) and the restricting pin. Except for the attachment bracket and the restricting pin, the same reference numerals are given to elements corresponding to those of the first and second embodiments and the description thereof will not be repeated.

In the third embodiment, as shown in FIG. 11, four attachment brackets 112, 114 are formed on the bucket 110. The attachment brackets 112 and attachment brackets 114 are separated from each other in the second rotation axis C2 direction. The two mounting brackets 112 are disposed inside the two flange portions 111, as in the first embodiment. The two mounting brackets 114 are disposed outside the two flange portions 111, as in the second embodiment. Restricting pins (restricting members) 115 are provided two each (four in total) separated from each other in the second rotation axis C2 direction and the circumferential direction. The two restricting pins 115 that are arranged in the axial direction are coaxially arranged in the second rotation axis C2 direction.

The restricting pins (restricting member) 115 on one end penetrate the attachment bracket 112 and the attachment bracket 114 to fix one of the flange portions 111 thereto. The restricting pins 115 on the other end penetrate the attachment bracket 112 and the attachment bracket 114 to fix the other of the flange portions 111 thereto. The restricting pin 115 has the same configuration as the restricting pin 113 except that the length is short.

This embodiment produces the same effects as the first embodiment described above. In the third embodiment, the restricting pins 115, which are consumable items, can be easily replaced Since the restricting pin 115 does not extend over the entire length of the bucket 110, there is a room for the speed reducers 3A and 3B to increase in its diameter. In the case of a rotary actuator, the rotation shafts 76*a* and 76*b* are disposed distant from the bucket 110, and when the distance from the center of rotation to the tip of the bucket 110 is set so as to correspond to the case of a cylinder type, the bucket 110 has to be made smaller in size due to space constraints. Whereas with the configuration of the embodiment, the bucket 110 can be advantageously extended into an empty space.

Figure 12:
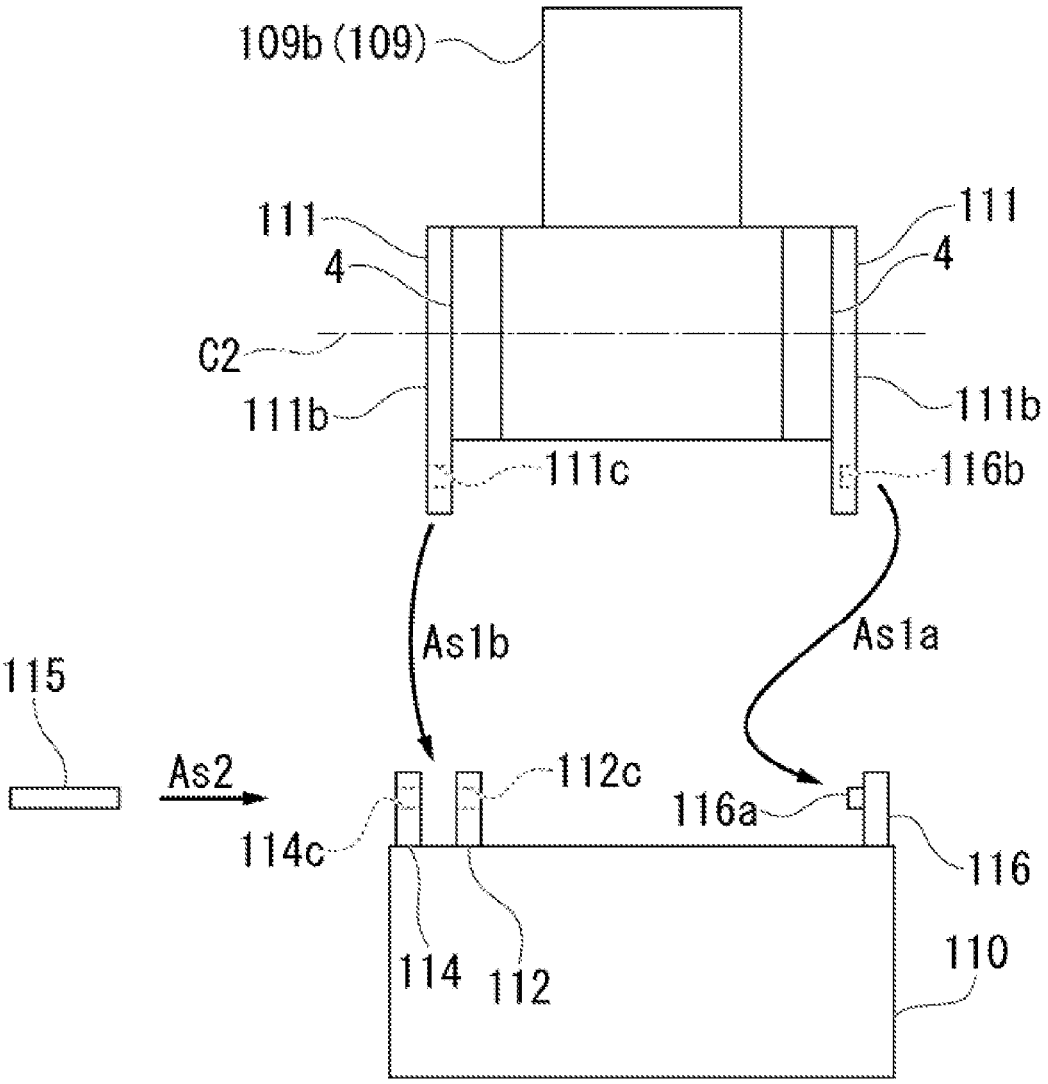
FIG. 12 is an exploded configuration diagram showing assembling process in a fourth embodiment of the present disclosure.

The following describes a drive transmission device and a construction machine relating to a fourth embodiment of the disclosure with reference to the accompanying drawings. FIG. 12 schematically illustrates an assembling process of the drive transmission device in the fourth embodiment. The fourth embodiment is different from the third embodiment in terms of the attachment bracket (bracket portion), the restricting member, and a receiving portion. Except for the attachment bracket, the restricting member, and the receiving portion, the same reference numerals are given to elements corresponding to those of the third embodiment and the description thereof will not be repeated.

As shown in FIG. 12, the attachment brackets 112 and 114 are arranged on each side of one of the flange portions 111 in the second rotation axis C2 direction, as in the third embodiment. On the other of the flange portions 111, only a single attachment bracket 116 is provided on the outer side in the second rotation axis C2 direction. The attachment bracket 116 is arranged at a position substantially same as the attachment bracket 114 of the second embodiment in the direction of the second rotation axis C2.

A convex portion 116*a* is formed as a restricting member on a surface of the attachment bracket 116 facing the inner side (surface facing the flange portion 111 in the assembled state) in the second rotation axis C2 direction. The convex portion 116*a* has, for example, a diameter substantially same as the restricting pins 113 and 115 described above. The dimension of the convex portion 116*a* where protrudes out in the second rotation axis C2 direction may be smaller than the thickness of the flange portion 111.

A concave portion 116*b* is formed as a receiving portion in an outer surface of the other flange portion 111 in the second rotation axis C2 direction. The concave portion 116*b* is configured to receive the convex portion 116*a*. No through hole is formed in the other flange portion 111 and the corresponding attachment bracket 116.

In the assembling process of the drive transmission device 1 in the fourth embodiment, the other of the flange portions 111 is brought close to the corresponding attachment bracket 116 as indicated by the arrow Asia in FIG. 12, and the convex portion 116*a* (restricting member) is then fitted into the concave portion (receiving portion) 116*b*. Next, as indicated by the arrow As1*b* in FIG. 12, one of the flange portions 111 is inserted between the corresponding attachment bracket 112 and attachment bracket 114. At this time, the through holes 111*c*, 112*c*, and 114*c* are aligned such that their axes coincide with each other. Further, the restricting pin 115 is inserted in the through holes 111*c*, 112*c*, 114*c* as indicated by the arrow As2 in FIG. 12 to fix, and the assembling process is completed.

This embodiment produces the same effects as the above first to third embodiment described above. In the fourth embodiment, the convex portion 116*a* may be configured to be replaceable, for example, the base portion of the convex portion 116*a* may be configured as a bolt and fastened to the attachment bracket 116. The flange portion 111 in which the concave portion 116*b* is formed may be configured to be replaceable. This has the advantageous effect that the replacement of consumable part is made easier.

Figure 13:
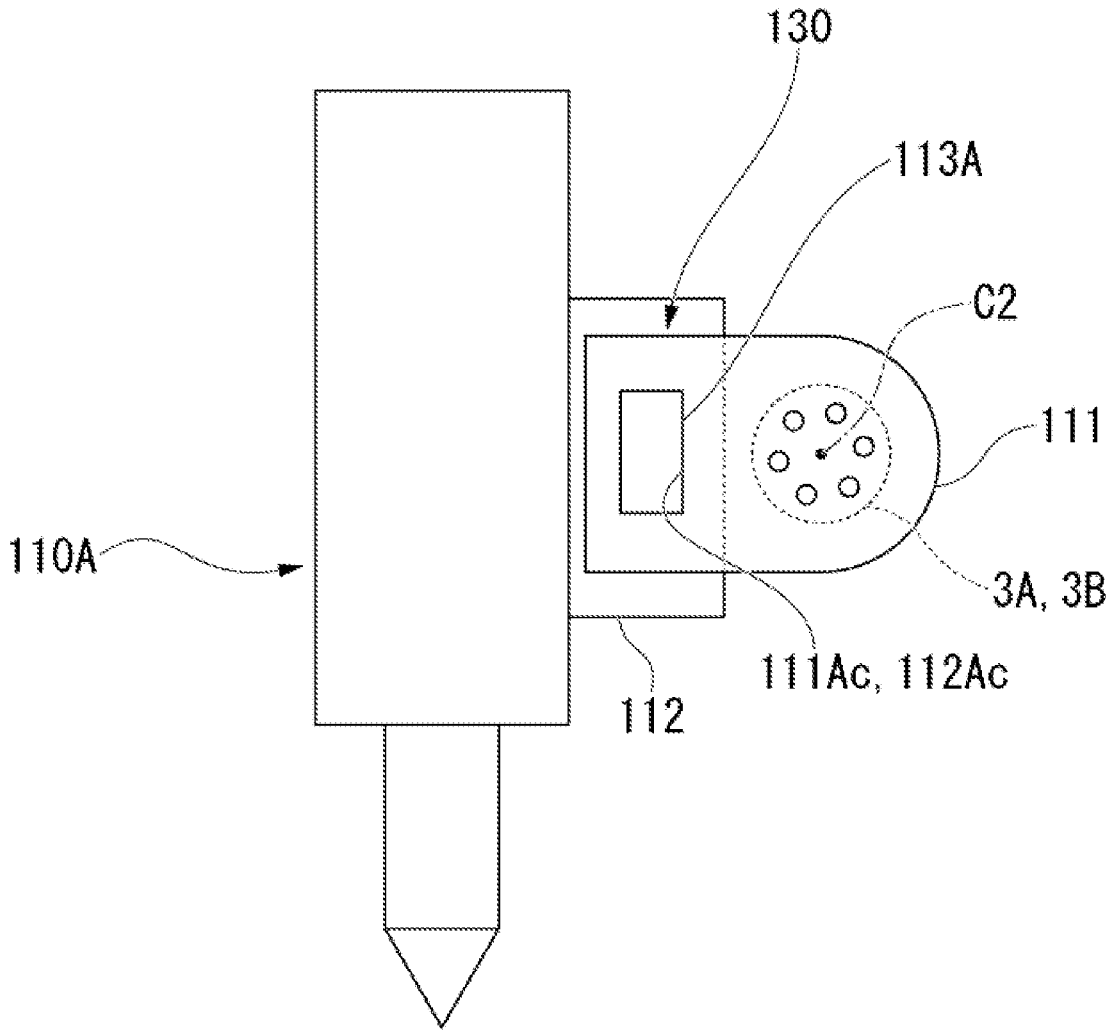
FIG. 13 schematically illustrates an overlapping region in the fifth embodiment of the present disclosure, viewed from the side.

A drive transmission device and a construction machine relating to a fifth embodiment of the disclosure will be now described with reference to the accompanying drawings. FIG. 13 schematically illustrates an assembled state of the drive transmission device in the fifth embodiment of the disclosure. The fifth embodiment is different from the above-described first embodiment in terms of the restricting member and the receiving portion. Except for the restricting member and the receiving portion, the same reference numerals are given to elements corresponding to those of the first embodiment and the description thereof will not be repeated.

In the fifth embodiment, a rectangular (polygonal) through hole 111Ac is formed in the flange portion 111 as shown in FIG. 13. Correspondingly, a rectangular through hole 112Ac is formed in the attachment bracket 112 as a receiving portion. One through hole 111Ac and one through hole 112Ac are formed. Further, as the restricting member, a restricting pin 113A having a rectangular section is inserted in the through hole 111Ac and the through hole 112Ac to be fixed therein in the second rotation axis C2 direction. Instead of the bucket 110, another attachment 110A is fixed to the attachment bracket 112.

According to the embodiment, since the through holes 111Ac and 112Ac that serve as the receiving portions are both formed in a rectangular shape and the restricting pin 113A is also formed in a rectangular shape in cross section, the attachment 110A does not move around the second rotation axis C2 relative to the speed reducers 3A and 3B although only one set of the receiving portions and the restricting member is provided.

This embodiment can also produce the same effects as the above-described embodiments.

The individual features of the above-described embodiments of the present disclosure can be selected and combined together. The foregoing embodiments disclosed herein describe a plurality of physically separate constituent parts. They may be combined into a single part, and any one of them may be divided into a plurality of physically separate constituent parts. Irrespective of whether or not the constituent parts are integrated, they are acceptable as long as they are configured to solve the problems.

1 . . . drive transmission device
3A, 3B . . . speed reducer
100 . . . excavator (construction machine)
109 . . . arm (first member)
110 . . . bucket (second member)
111 . . . flange portion
111*c* . . . through hole (receiving portion)
112, 114, 116 . . . attachment bracket (bracket portion)
112*c*, 114*c* . . . through hole (receiving portion)
113 115 . . . restricting pin (restricting member)
116*a* . . . convex portion (restricting member)
116*b* . . . concave portion (receiving portion)
120 . . . motor (drive source)
130 . . . overlapping region
C2 . . . second rotation axis (rotation axis)

What is claimed is:

1. A drive transmission device, comprising:

at least one speed reducer attached to a first member, the speed reducer transmitting a rotational force from a drive source to a second member that is rotatable about a rotation axis and coupled to the first member;

at least two bracket portions provided in the second member, the at least two bracket portions being arranged apart from each other in a direction along the rotation axis;

at least one flange portion disposed so as to extend in a direction intersecting the rotation axis, the flange portion connecting the speed reducer and the bracket portions;

a restricting member disposed so as to extend in the direction of the rotation axis, the restricting member restricting a relative rotational movement of the bracket portions and the flange portion; and a receiving portion receiving the restricting member, wherein the restricting member and the receiving portion are disposed in an overlapping region, the overlapping region being defined as a region where the bracket portion and the flange portion overlap each other viewed from the direction of the rotation axis, wherein one set of the receiving portion and the restricting member is provided around the rotation axis, and wherein the receiving portion have a polygonal sectional shape viewed in a direction, intersecting the rotation axis.

2. The drive transmission device of claim 1, wherein two or more sets of the receiving portion and the restricting member are provided around the rotation axis, and wherein the receiving portions have a round sectional shape viewed in a direction intersecting the rotation axis.

3. The drive transmission device of claim 2, wherein the restricting member is a restricting pin extending in the direction of the rotation axis, wherein the receiving portion is through holes formed in the bracket portions and the flange portion, and wherein the through holes receive the restricting pin.

4. The drive transmission device of claim 1, wherein at least two speed reducers are provided in the first member, the at least two speed reducers are separated from each other in a direction along the rotation axis, wherein the flange portion is provided for each of the at least two speed reducers, and the flange portions are respectively connected to the at least two speed reducers, wherein the bracket portions are disposed apart from each other in the direction of the rotation axis, and wherein the bracket portions are disposed between the flange portions adjacent to each other in the direction of the rotation axis.

5. The drive transmission device of claim 1, wherein at least two speed reducers are provided in the first member, the at least two speed reducers are separated from each other in the direction along the rotation axis, wherein the flange portion is provided for each of the at least two speed reducers, and the flange portions are respectively connected to the at least two speed reducers, wherein the at least two bracket portions are disposed apart from each other in the direction of the rotation axis, and wherein the flange portions are disposed between the bracket portions adjacent to each other in the direction of the rotation axis.

6. The drive transmission device of claim 1, wherein at least two speed reducers are provided in the first member, the at least two speed reducers are separated from each other in the direction along the rotation axis, wherein the flange portion is provided for each of the at least two speed reducers, and the flange portions are respectively connected to the at least two speed reducers, wherein the at least two bracket portions are disposed apart from each other in the direction of the rotation axis, wherein any one of the flange portions is disposed between the two bracket portions disposed apart from each other in the direction of the rotation axis, wherein the restricting member is a restricting pin extending in the direction of the rotation axis, wherein the receiving portion is through holes formed in the bracket portions and one of the flange portions, and wherein the through holes receive the restricting pin.

7. The drive transmission device of claim 1, wherein the restricting member is a restricting pin extending in the direction of the rotation axis, wherein the receiving portion is through holes formed in the bracket portions and the flange portion, and wherein the restricting pin is inserted in the through holes.

8. A drive transmission device, comprising:

two speed reducers attached to a first member, the first member being coupled to a second member such that the second member is rotatable about a rotation axis;

two bracket portions provided on the second member, the two bracket portions being disposed apart from each other in a direction along the rotation axis;

at least two flange portions disposed such that they extend in a direction intersecting the rotation axis, the flange portions respectively connecting the speed reducers and the bracket portions;

a restricting member being arranged so as to extend in the direction of the rotation axis, the restricting member restricting a relative rotational movement about the rotation axis between the bracket portion and the flange portion; and a receiving portion receiving the restricting member, wherein the two speed reducers are attached at positions where they are separated from each other in the direction along the rotational axis of the first member, and the two speed reducers synchronously transmit a rotational force from a drive source to the second member, wherein when the speed reducer, the bracket portion, and the flange portion that are connected to each other are defined as a set, the bracket portion and the flange portion in each set are disposed in an overlapping region, the overlapping region being defined as a region where the bracket portion and the flange portion overlap each other viewed from the direction of the rotation axis, and wherein the flange portion and the bracket portion in one set are disposed apart from the flange portion and the bracket portion in the other set in the direction of the rotation axis, wherein the receiving portion is through holes formed in the bracket portions and the flange portions, wherein the restricting member is a restricting pin extending in the direction of the rotation axis, and wherein the restricting pin is received in the through holes of the flange portion and the bracket portion in one set and the through holes of the flange portion and the bracket portion in the other set.

9. A construction machine comprising:

a first member having a drive source that generates a rotational force; and a second member coupled to the first member via a drive transmission device such that the second member is rotatable about a rotation axis, wherein the drive transmission device includes:

a speed reducer provided in the first member at a position close to the second member, the speed reducer transmitting a rotational force from the drive source to the second member;

at least two bracket portions provided in the second member at positions close to the first member, the at least two bracket portions being arranged apart from each other in a direction along the rotation axis;

a flange portion disposed so as to extend in a direction intersecting the rotation axis, the flange portion connecting the speed reducer and the at least two bracket portions;

a restricting member being arranged so as to extend in the direction of the rotation axis, the restricting member restricting a relative rotational movement about the rotation axis between the at least two bracket portions and the flange portion; and a receiving portion receiving the restricting member, wherein the at least two bracket portions and the flange portion are disposed in a overlapping region, the overlapping region being defined as a region where the at least two bracket portions and the flange portion overlap each other viewed from the direction of the rotation axis, and wherein the restricting portion and the receiving portion allow movement of the flange portion relative to the at least two bracket portions in the direction of the rotation axis between the at least two bracket portions adjacent to each other in the rotation axis direction.

10. A drive transmission device, comprising:

at least one speed reducer attached to a first member, the speed reducer transmitting a rotational force from a drive source to a second member that is rotatable about a rotation axis and coupled to the first member;

at least two bracket portions provided in the second member, the at least two bracket portions being arranged apart from each other in a direction along the rotation axis;

at least one flange portion disposed so as to extend in a direction intersecting the rotation axis, the flange portion connecting the speed reducer and the bracket portions;

a restricting member disposed so as to extend in the direction of the rotation axis, the restricting member restricting a relative rotational movement of the bracket portions and the flange portion; and a receiving portion receiving the restricting member, wherein the restricting member and the receiving portion are disposed in an overlapping region, the overlapping region being defined as a region where the bracket portion and the flange portion overlap each other viewed from the direction of the rotation axis, wherein at least two speed reducers are provided in the first member, the at least two speed reducers are separated from each other in the direction along the rotation axis, wherein the flange portion is provided for each of the at least two speed reducers, and the flange portions are respectively connected to the at least two speed reducers, wherein the at least two bracket portions are disposed apart from each other in the direction of the rotation axis, wherein any one of the flange portions is disposed between the two bracket portions disposed apart from each other in the direction of the rotation axis, wherein the restricting member is a restricting pin extending in the direction of the rotation axis, wherein the receiving portion is through holes formed in the bracket portions and one of the flange portions, and wherein the through holes receive the restricting pin.

* * * * *